US006590484B2

(12) United States Patent
Garcia, Jr. et al.

(10) Patent No.: US 6,590,484 B2
(45) Date of Patent: Jul. 8, 2003

(54) INSULATED CIRCULATOR

(76) Inventors: Eugene Garcia, Jr., 25 Jordan's Wood Cir., San Antonio, TX (US) 78248; Rodger Billings, Box 1047, Pioneer, CA (US) 95666

( * ) Notice: Subject to any disclaimer, the term of this patent is extended or adjusted under 35 U.S.C. 154(b) by 88 days.

(21) Appl. No.: 09/951,067

(22) Filed: Sep. 12, 2001

(65) Prior Publication Data

US 2003/0048166 A1 Mar. 13, 2003

(51) Int. Cl.[7] ..... H01F 27/06

(52) U.S. Cl. ..... 336/65; 336/200; 336/83; 333/1.1; 333/24.2

(58) Field of Search ..... 336/65, 83, 192, 336/199, 200, 232; 333/1.1, 24.2, 24.3, 24.1, 24 R

(56) References Cited

U.S. PATENT DOCUMENTS 4,812,787 A * 3/1989 Kuramoto et al. ..... 333/1.1
5,068,629 A * 11/1991 Nishikawa et al. ..... 333/1.1
6,121,851 A * 9/2000 Takane et al. ..... 333/1.1
6,417,741 B2 * 7/2002 Jodo ..... 333/1.1

* cited by examiner

*Primary Examiner*—Tuyen T. Nguyen
(74) *Attorney, Agent, or Firm*—Cline H. White; Jackson Walker L.L.P.

(57) ABSTRACT

The present invention provides for a grounded circulator that is isolated from the environment. Thus, the circulator of the present invention allows circuit board manufacturers to wash the finished, or partially finished, circuit board after the present invention has been attached to the circuit board without damaging the circulators. The present invention does this by incorporating a novel means for grounding the ferrites of the circulator using a grounding foil wrap so that traditional methods for grounding the ferrites which necessitate that the circulator be unsealed, such as screws and use of the circulator cover, are not used. The present invention also provides for communication by the circulator with other electronic components without compromising the isolation of the interior of the circulator through the use of embedded microstrips.

7 Claims, 15 Drawing Sheets

INSULATED CIRCULATOR

BACKGROUND OF THE INVENTION

1. Field of the Invention

Applicants' invention relates to a circulator device that is isolated from the environment. More particularly, it relates to a circulator with a wrapped foil ground and a sealed cover that allows the exterior of the circulator to be washed without damaging the function of the circulator.

2. Background Information

Ferrite devices have been well known since the mid-1900s. The term "ferrite" means "ironlike" in that a ferrite material has magnetic properties, although ferrites are a class of ceramic material. The first work with ferrite materials was done in the late 1940s. Since that time, many ferrite devices have been developed and are found in a variety of applications including refrigerator doors, tape recording heads, a.m. radio antennas, and microwave applications. Although many of the ferrite devices have a fairly simply configuration, consisting typically of ferrite material and magnet(s) in a metallic structure, ferrite devices abound with subtleties.

One of the most useful ferrite devices, the junction circulator, was developed in the late 1950s. A circulator is a microwave coupling device having three or more terminals that provides for energy entering a first terminal to be transmitted to the next adjacent terminal in a specific direction. Thus, in a three-port circulator, the junction circulator takes energy incident on port 1 and "circulates" it to port 2, energy incident on port 2 exists via port 3 and energy incident on port 3 exits port 1. If port 3 is terminated by introducing material that absorbs energy, an isolator is produced. Thus, energy is passed from port 1 to port 2, but returning energy is circulated to port 3 where it is absorbed, and thus the source is "isolated" from the load. Circulator junctions may be combined in numbers greater than three, for example, the four port circulator. Circulators and isolators are the most common microwave ferrite devices and are found in many applications including radar and satellite.

Two of the most common kinds of ferrite devices are the circulator and the isolator. A circulator is a three or more port device which "circulates" microwave energy from port to port. For example, in a three port circulator, energy is circulated from port 1 to 2, 2 to 3, and 3 to 1. An isolator is a three port circulator with an energy absorbing "load" connected to port 3. "Circulation" is accomplished by routing microwave energy through a magnetized ferrite material. The material is a ceramic with magnetic properties, and is generally fired in a kiln like other ceramics. Circulators are commonly used in microwave radios (and other microwave systems) to absorb reflected energy protecting amplifiers and other circuit functions. A circulator is used in "duplexing" a transmitter and a receiver such that they can share the same antenna. For example, the transmitter is connected to port 1, the antenna to port 2, and the receiver to port 3.

The general structure of a circulator includes a circuit sandwiched between a top ferrite and a bottom ferrite with a magnet above the top ferrite and a cover. The top and bottom ferrites must be grounded to one another. Three traditional methods exist for grounding the top and bottom ferrite disks. In the first, two steel plates, a top and a bottom, are added to either side of the top ferrite and the bottom ferrite. The steel plates are in contact with the ferrite disks and are grounded to one another by use of screws between the two steel plates. The screws also act to hold the assembly together. In this configuration, the magnet may also be used as a grounding path because it is generally plated. The problem with this design is that the magnets do not always touch the top steel plate. Also, the screws tend to be a poor grounding path. If the threads of the steel plates or the screws get stripped, they will not have good contact and thus give poor grounding.

A second traditional design uses the cover as a grounding path. In this assembly, a grounding disk in contact with the top ferrite contacts the side walls of the steel cover which in turn contacts a steel baseplate which is in contact with the bottom ferrite. This design is easy to build, but relies on the steel cover to provide the grounding path to the top of the ferrite to the bottom. If the grounding disk does not touch the sides, the grounding path is lost. Additionally, this design also increases the distance of the grounding path.

A third design is similar to the second in that a cover is used to create a grounding path. However, the third design a full cover is used rather than a grounding disk and sidewalls attached to a baseplate. In the third traditional assembly, a full cover is attached about the ferrite assembly to a baseplate. This type of assembly has the same problems as the second.

In current, conventional circuit board production methods, the circuit board is constructed and then washed after completion in order to remove foreign matter from the circuit board. This washing can damage the circulator. Additionally, once the circuit board and attached circulator are in use, environmental moisture may come in contact with both, further providing the chance for damage to the circulator.

Thus, there is a need for a circulator device that functions as a traditional circulator, but is insulated from the environment in order that moisture cannot damage the circulator. Further, it is advantageous to decrease the distance of the grounding path of the circulator assembly.

SUMMARY OF THE INVENTION

The present invention provides for a grounded circulator that is isolated from the environment.

The present invention provides a novel apparatus that will allow circuit board manufacturers to wash the circuit board upon completion without damaging the circulators. The present invention further provides:

a. A reduction in the grounding pathway distance;

b. A circulator assembly that assures ground contact between the top and bottom ferrites;

c. A highly conductive, grounding path material;

d. A grounded circuit assemble that is easily manufactured;

e. A grounding pathway that does not require touching the sides of the steel cover or use of screws; and f. A baseplate with notches shaped to accept an insert having either a hole to run the circuit tab through and an embedded microstrip to contact the circuit tab.

In order to solve the difficulties presented in attempting to obtain these features, an improved insulated circulator apparatus has been developed which isolates the grounded circuit assembly within a sealed, insulating cover.

Specifically, the present invention provides for a grounded circuit assembly which is comprised of two ferrite disks sandwiching a circuit, and wrapped with a grounding foil. Other components of the circulator, such as the pole piece and magnet, can be placed either within the grounding foil wrap or outside the grounding foil wrap and the entire grounded circuit assembly and additional components are sealed with an insulating cover attached to a baseplate. The baseplate has a plurality of notches corresponding with the number of circuit tabs of the circuit. The circuit tabs extend to the notches. Inserts are placed in the notices than can have either a hole through which the circuit tab can be extended, or a microstrip may be embedded through the insert. If the insert has a hole and the circuit tab is placed within the hole, a sealing material may be used in the hole to maintain the insulated integrity of the circulator. In either embodiment, the inserts allow communication between the circulator and other electronic sources or components while keeping the interior of the circulator, including the grounded circuit assembly, isolated from the environment and moisture.

DETAILED DESCRIPTION OF THE PREFERRED EMBODIMENT

Figure 1:
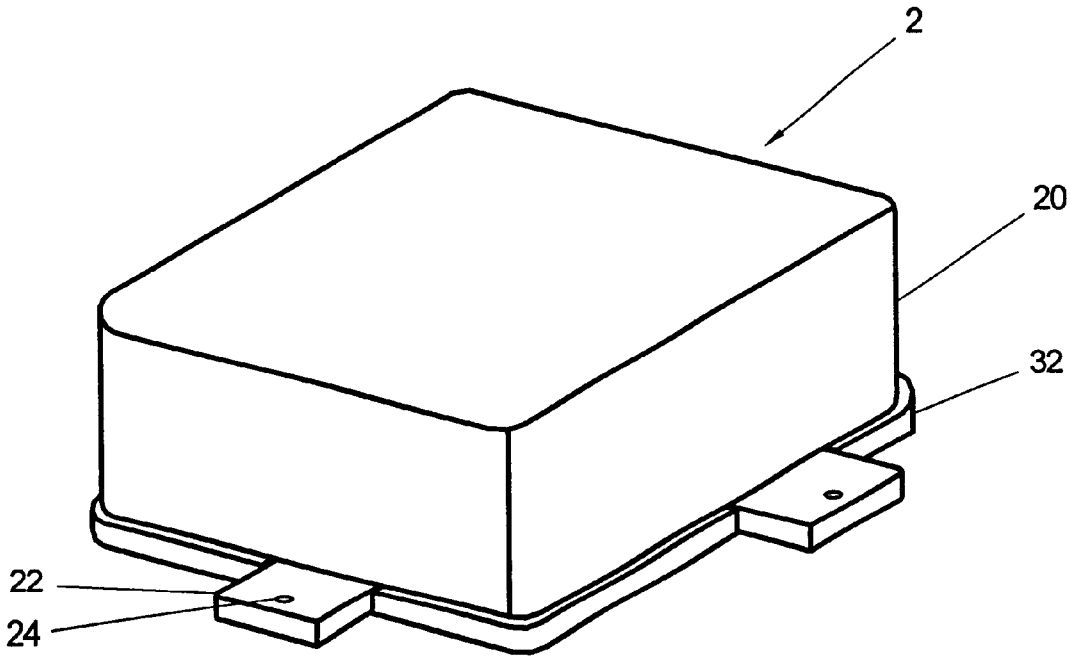
FIG. 1. is a perspective view of the present invention.

Referring to the figures, FIG. 1 shows the present invention from a perceptive view. The circular (2) is designed to isolate its internal components from the outside environment. This is accomplished by having an insulating cover (20) attached to the baseplate (32) about the internal components. Because the cover (20) can be sealed to the baseplate (32), the interior of the cover (20) and baseplate (32) is isolated from the environment. In order to communicate with other electronic circuitry or devices (not shown), the circulator (2) has one or more inserts (22) through which communication from the outside to the inside of the circulator (2) is possible. In a first embodiment, a microstrip (24) is embedded in the insert (22) with the microstrip (24) extending through the insert (22). This allows the microstrip (24) to be in contact with the circuit tabs (30) (not shown) and the microstrip (24) extending outside the circulator (2). The micros strips (24) can then be soldered or otherwise placed in connection with other conductive materials in order for communication between the circulator (2) and other electronic devices (not shown).

Figure 2:
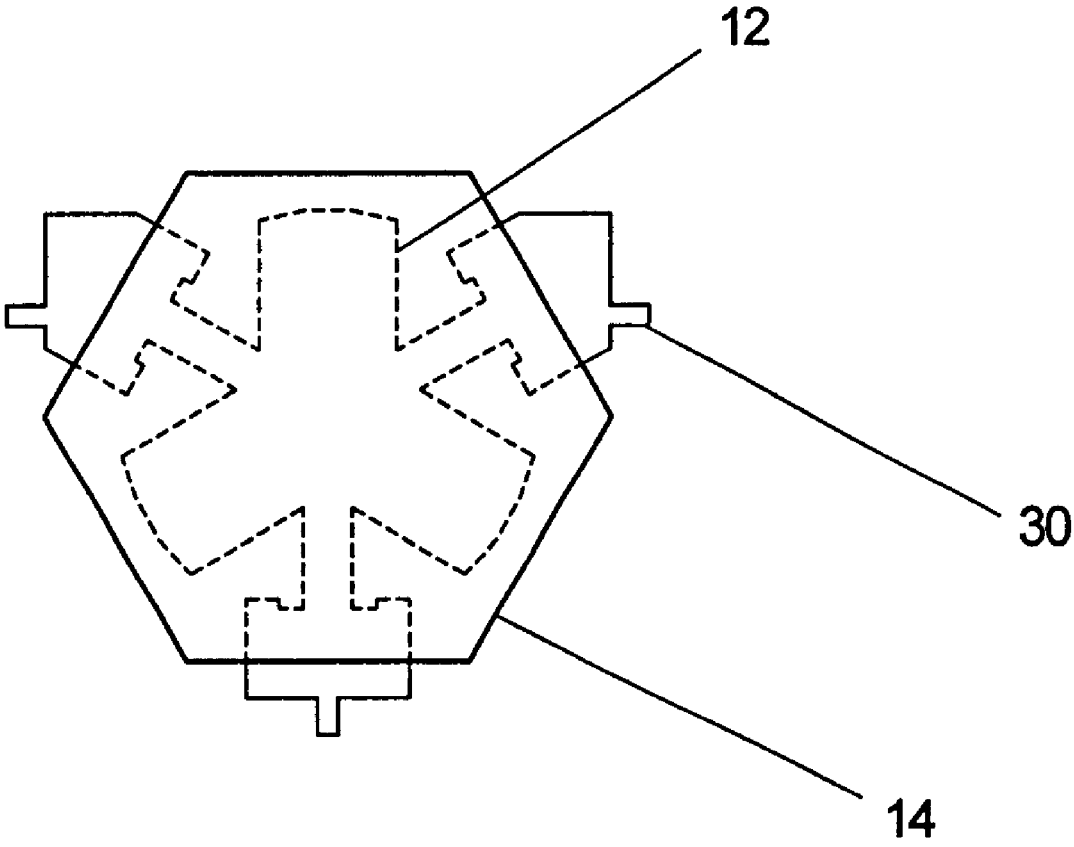
FIG. 2. is a top view of the circuit and ferrites.

FIG. 2 is a top view of the first ferrite (14) and circuit (12). It shows the orientation of the circuit (12) in relation to the first ferrite (14). Circuit (12) is disposed between the first ferrite (14) and the second ferrite (16). Second ferrite (16) rests below first ferrite (14) and is not viewable in this figure. This figure also illustrates the orientation of the circuit tabs (30) which extend outwardly from the circuit (12) beyond the first ferrite (14) and the second ferrite (16).

Figure 3:
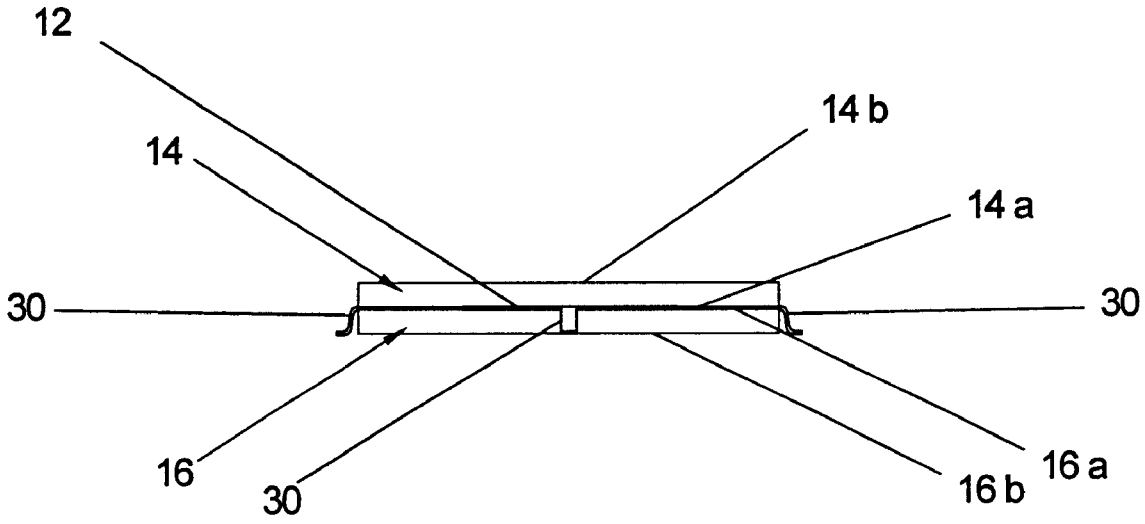
FIG. 3. is a side view of the circuit and ferrites.

FIG. 3 illustrates the ferrites (14 and 16) and circuit (12) from a side view. This figure more clearly illustrates the disposition of the circuit (12) between the first ferrite inner surface (17) and the second ferrite inner surface (16A). Further illustrated are the circuit tabs (30) which extend outwardly from between the first ferrite (14) and the second ferrite (16).

Figure 4:
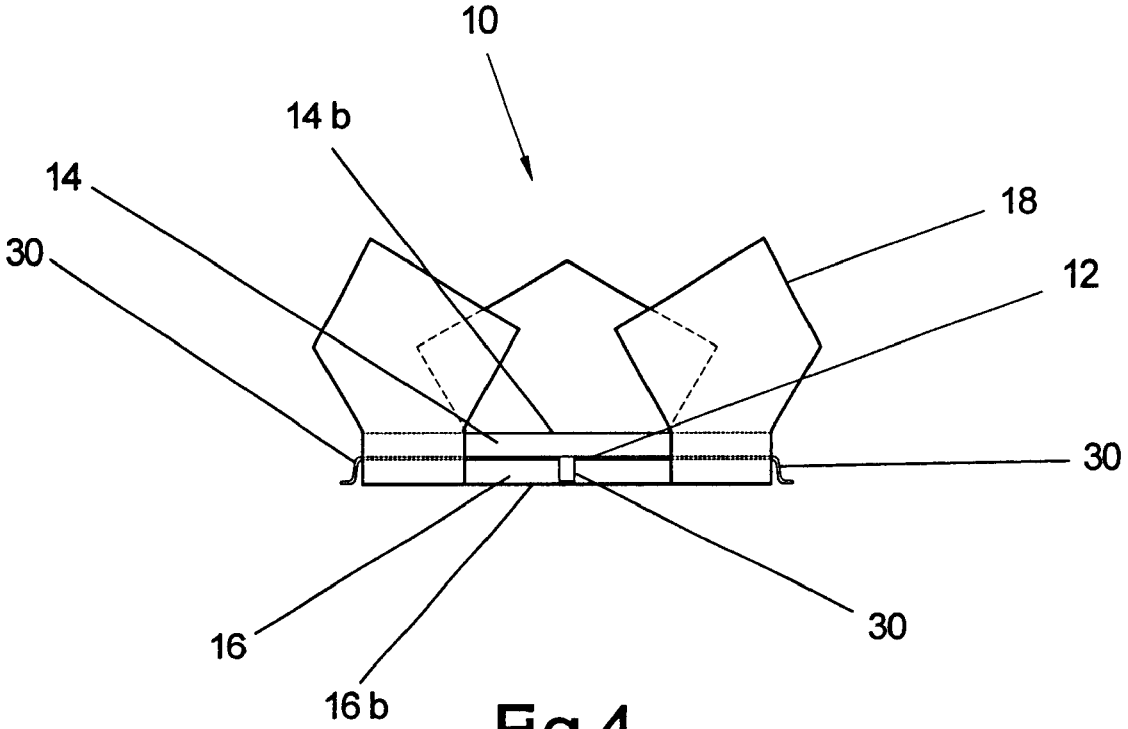
FIG. 4. is a side view of the circuit, ferrites, and partially folded grounding wrap.

FIG. 4 shows the ferrites (14 and 16) and the circuit (12) from a side view. In this figure, the grounding foil wrap (18) is partially attached to the second ferrite (16) with the remaining portions of the grounding foil wrap (18) extending above the first ferrite (14). The grounding circuit assembly (10) is completed by wrapping the first ferrite (14), the circuit (12), and the second ferrite (16) with the grounding foil wrap (18). This figure shows the ferrites (14 and 16) and circuit (12) partially wrapped by the grounding foil wrap (18). Although shown in one possible shape, the grounding foil wrap (18) can be cut in many shapes and variations, however, the grounding foil wrap (18) shape should allow for the grounding foil wrap (18) to contact both the first ferrite outer surface (14B) and the second ferrite outer surface (16B), thus grounding the ferrites (14 and 16). Furthermore, the configuration of the grounding foil wrap (18) should be such that it allows the circuit tabs (30) to extend from the grounded circuit assembly (10) without contacting the grounding foil wrap (18).

Figure 5:
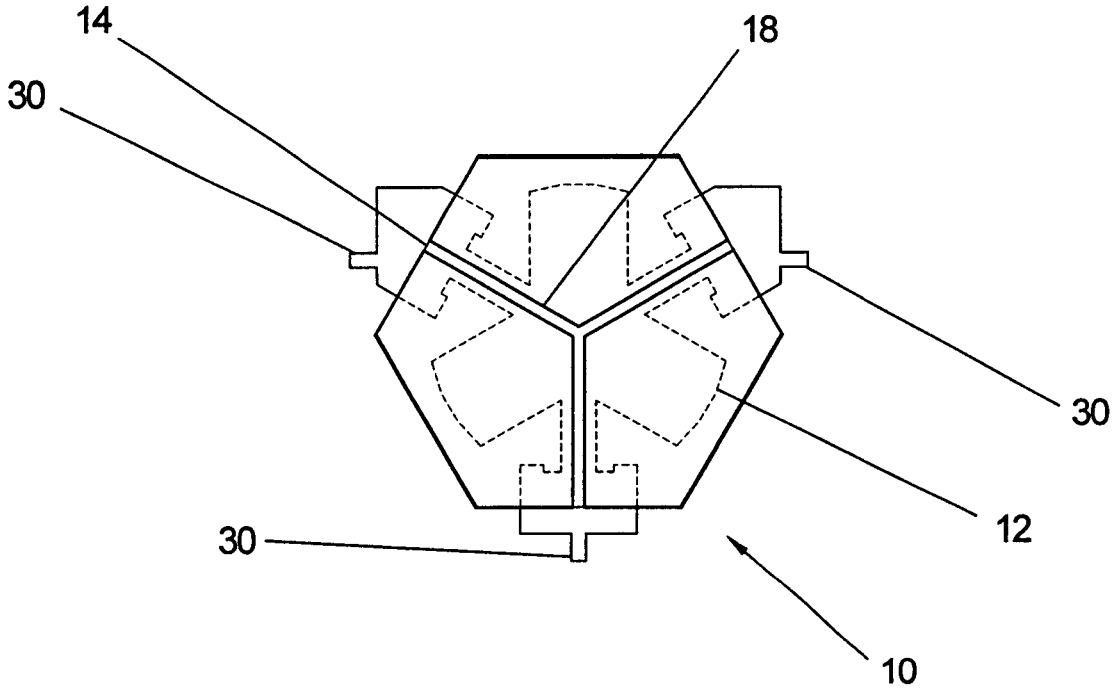
FIG. 5. is a top view of the grounded circuit assembly.

FIG. 5 is a top view of the grounded circuit assembly (10). The grounding foil wrap (18) is shown in place wrapped around the first ferrite (14) and the circuit (12). This figure further shows that the grounding foil wrap (18) does not hinder or enclose the circuit tabs (30) from extending outwardly from the grounded circuit assembly (10).

Figure 6:
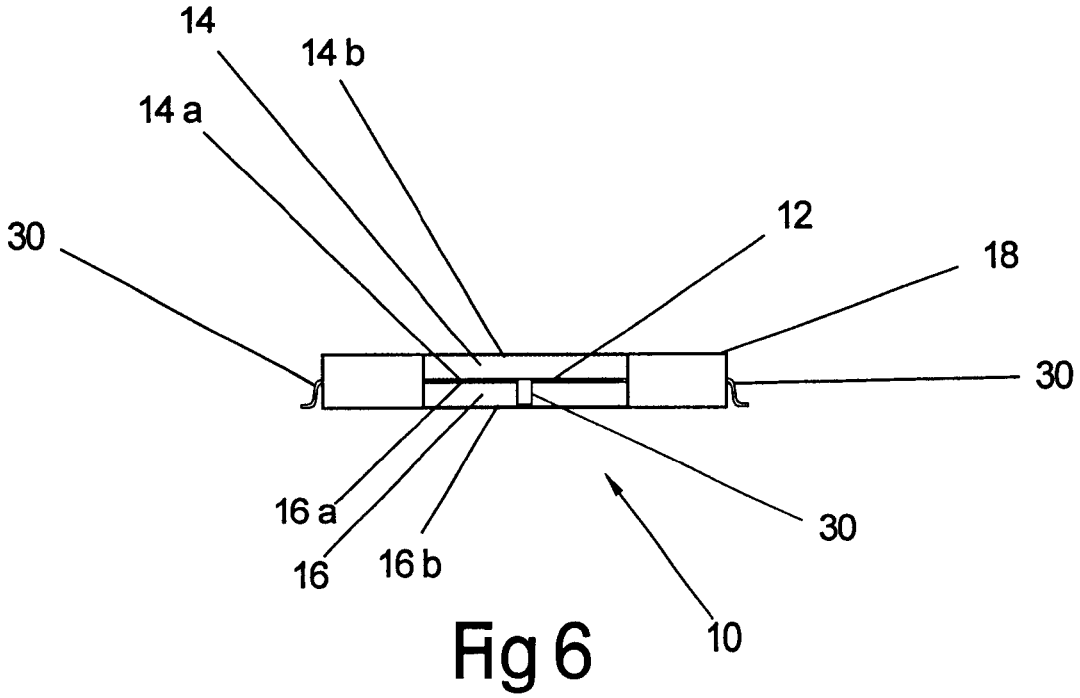
FIG. 6. is a side view of the grounded circuit assembly.

FIG. 6 shows the grounded circuit assembly (10) from a side view. This figure more clearly shows the orientation of the first ferrite (14), circuit (12), and second ferrite (16). The grounded circuit assembly is completed with the grounding foil wrap (18) is disposed about both the first ferrite outer surface (14B) and the second ferrite outer surface (16B). Also shown extending from the first ferrite (14) and the second ferrite (16) are the circuit tabs (30).

Figure 7:
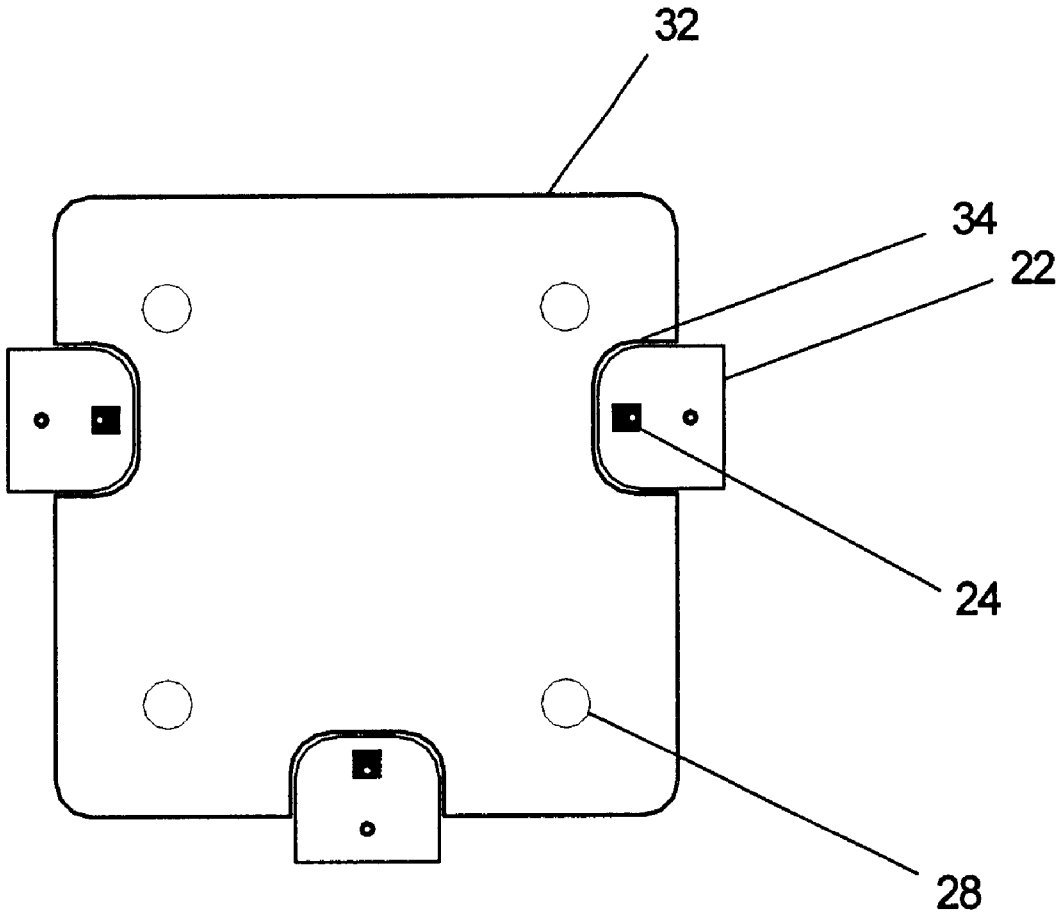
FIG. 7. is a top view of the baseplate and inserts.

FIG. 7 illustrates a top view of the baseplate (32) with the inserts (22) but with the other components removed This figure more clearly shows the notches (34) which are shaped to accept an insert (22). Although this figure illustrates a specific shape of notch (34) and insert (22), this is not intended to be limiting and the notch (34) and insert (22) could be made from many shapes. The inserts (22) are urged into the notices (34). Each insert (22) has a metallic microstrip (24) which serves to contact with the circuit tabs (30)(not shown). The microstrips (24) extend from the insert top surface (22A) through the insert (22) to the insert bottom surface (22B). Also shown in this figure are the alignment dimples (28).

Figure 8:
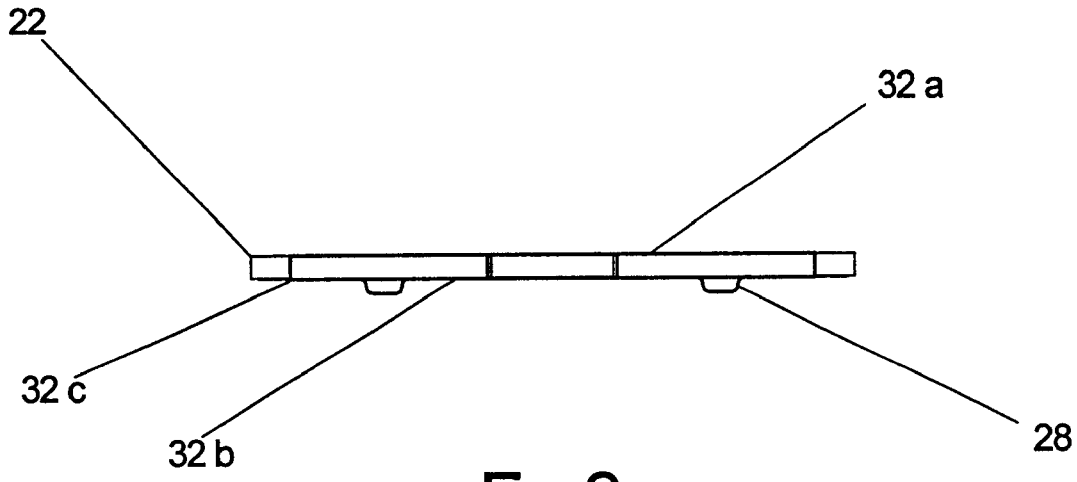
FIG. 8. is a side view of the baseplate and inserts.

FIG. 8 is a side view of the baseplate (32). The baseplate outer edge (32C) is shaped to form the notices (34). The alignment dimples (28) extend from the baseplate bottom surface (32B) for orienting the finished circulate (2) on the circuit board (not shown). The remainder of the circulator (2) is attached to the baseplate top surface (32A).

Figure 9:
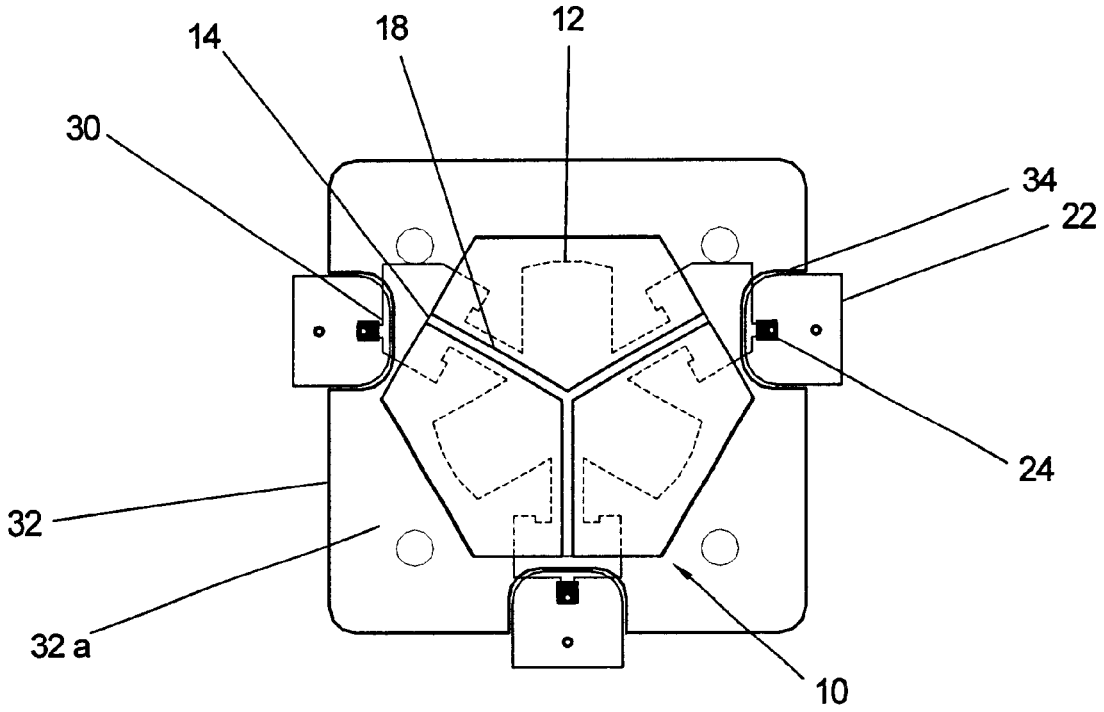
FIG. 9. is a top view of the grounded circuit assembly and baseplate.

FIG. 9 illustrates the combination of the baseplate (32) assembly and the grounded circuit assembly (10). In this figure, the grounded circuit assembly (10) has been attached to the top surface (32A) of the baseplate (32). The circuit (12) is illustrated below the first ferrite (14). Disposed about the ferrites (14) and (16)(not viewable) is the grounding foil wrap (18). Also shown in this figure are the circuit tabs (30), which contact the microstrips (24) of the inserts (22), which have been urged into the notches (34).

Figure 10:
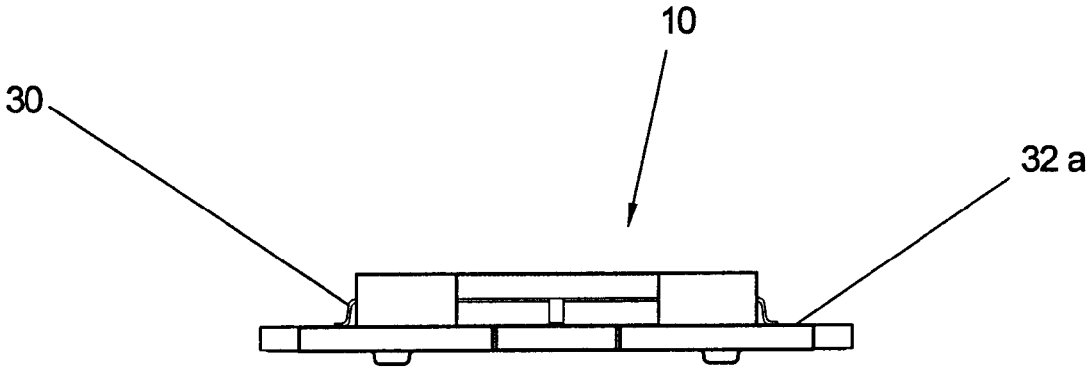
FIG. 10. is a side view of the grounded circuit assembly and baseplate.

FIG. 10 is a side view of the baseplate (32) and grounded circuit assembly (10) apparatus. It again illustrates the grounded circuit assembly (10) attached to the baseplate top surface (32A). Also shown are the circuit tabs (30) extending from the grounded circuit assembly (10) in order to contact the microstrips (24)(not shown).

Figure 11:
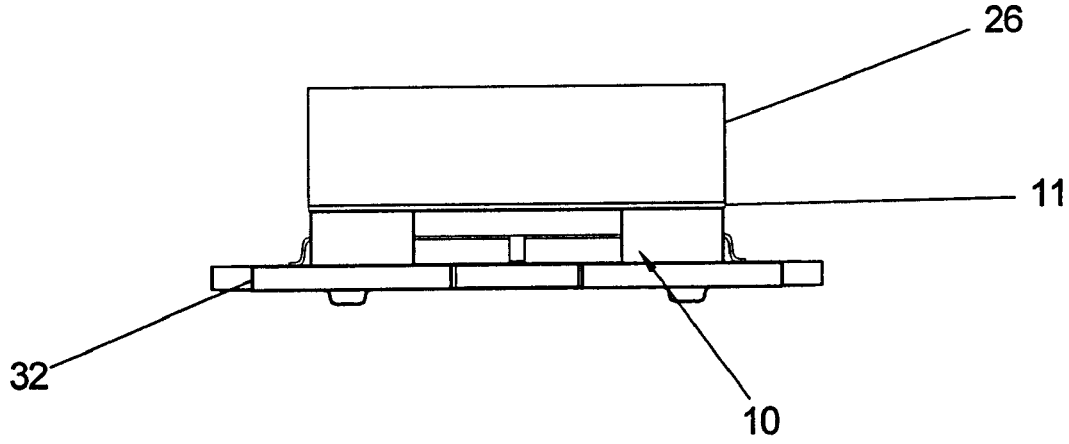
FIG. 11. is a side view of the present invention without the insulating cover.

FIG. 11 is a side view showing the pole piece (11) attached to the grounded circuit assembly (10), which in turn is attached to the baseplate top surface (32A). A magnet (26) is attached to the pole piece (11) opposite the grounded circuit assembly (10). The pole piece (11) acts to distribute the magnetic field generated by the magnet (26) uniformly across the first ferrite outer surface (14B). The cut away portion of this figure again illustrates the orientation of the circuit (12) and the first ferrite (14). Disposed about the ferrites (14 and 16) and circuit (12) is the grounding foil wrap (18) which serves to de-couple the grounding path of the first ferrite (14) and second ferrite (16) from the side walls of the cover (not shown) or screws (not shown) which are conventionally used as grounding paths.

Figure 12:
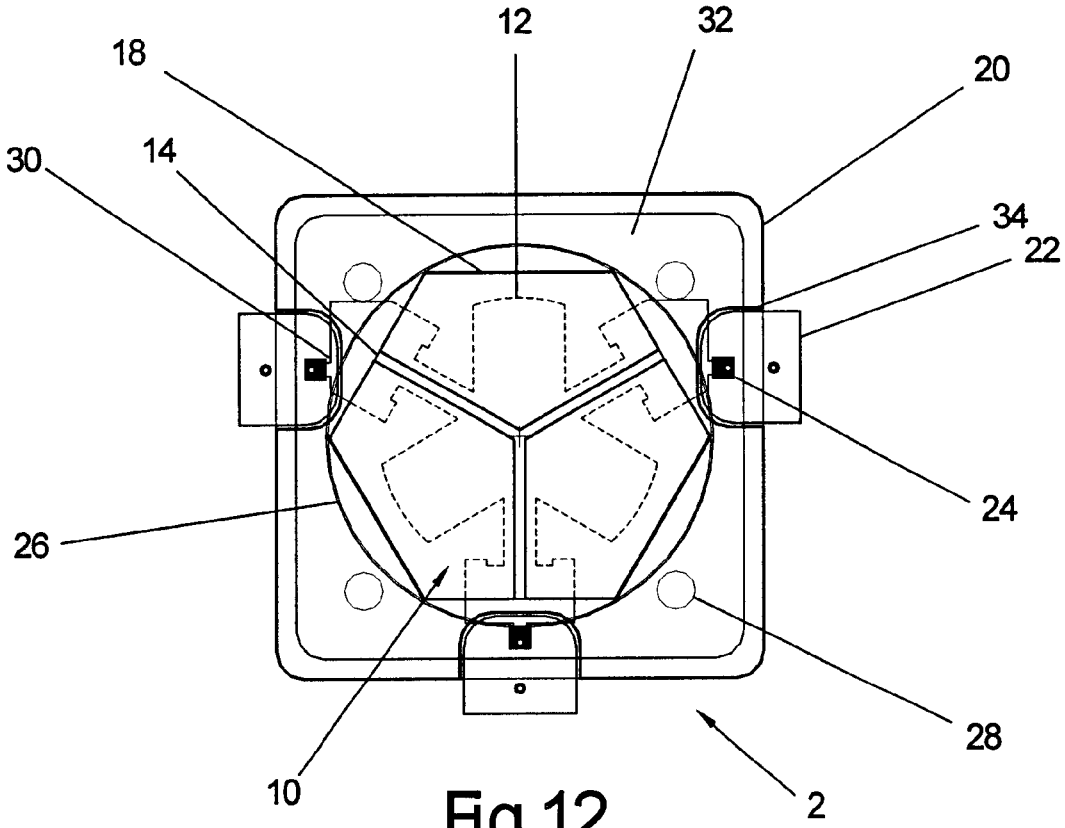
FIG. 12. is a top, cut-away view of the present invention.

FIG. 12 shows a cutaway, top view of the present invention. The circulator (2) is made up of the baseplate (32) the grounded circuit assembly (10), the magnet (26), and the cover (20). Also shown are the inserts (22) in the notches (34). Alignment dimples (28) may be present in order to help orient the circulator (2). The cutaway of this figure also shows, in this embodiment, the octagonal first ferrite (14), and circuit (12). Circuit (12) extends to each notch (34) and a circuit tab (30) contacts a microstrip (24) that extends through the inserts (22). A magnet (26) rests on the grounded circuit assembly (10) and the cover (20) encloses the grounded circuit assembly (10) and magnet (26), and contacts the baseplate (32).

Figure 13:
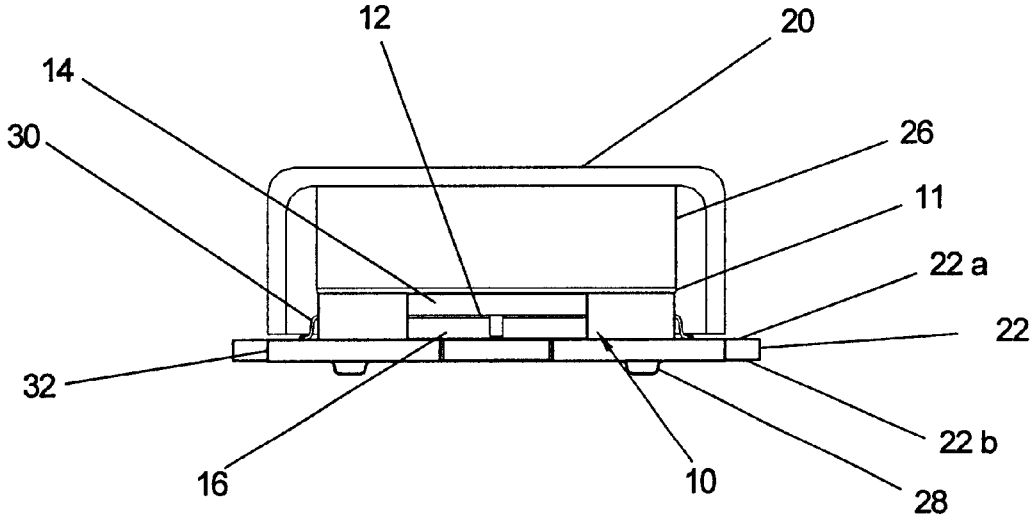
FIG. 13. is a side, cut-away view of the present invention.

FIG. 13 shows a side cutaway view of the circulator (2). This figure shows the baseplate (32) and the attached cover (20). Inside the space created by the baseplate (32) and cover (20) is the grounded circuit assembly (10) and the magnet (26). This view shows the first ferrite (14) and the second ferrite (16) of the grounded circuit assembly (10). The circuit (12) rests between the first ferrite (14) and the second ferrite (16). This figure also illustrates the circuit tabs (30) extending beyond the edges of the first ferrite (14) and the second ferrite (16) and extending downwardly to contact the microstrip (24)(not shown) at the insert top surface (22A). The microstrip (24) is embedded within insert (22) and extends from the insert top surface (22A) through insert (22) to the insert bottom surface (22B) where it may contact other conductive pathways (not shown). Also illustrated here are the alignment dimples (28) on the baseplate bottom surface (32B) which extend downwardly to contact receiving holes in the circuit board (not shown).

Figure 14:
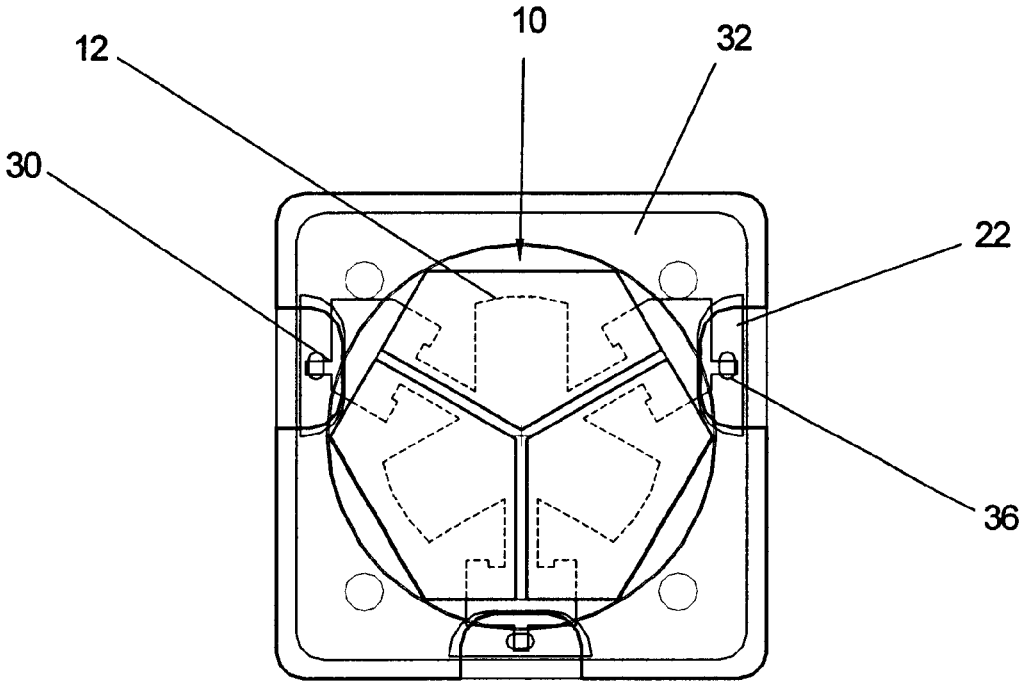
FIG. 14. is a top, cut-away view of a second embodiment of the present invention.

FIG. 14 is a top view of the present invention showing the second embodiment of the inserts (22) with the grounded circuit assembly (10) attached to the baseplate (32). As shown in this figure, extending from the grounded circuit assembly (10) are the circuit tabs (30) which are inserted in the apertures (36) of the inserts (22).

Figure 15:
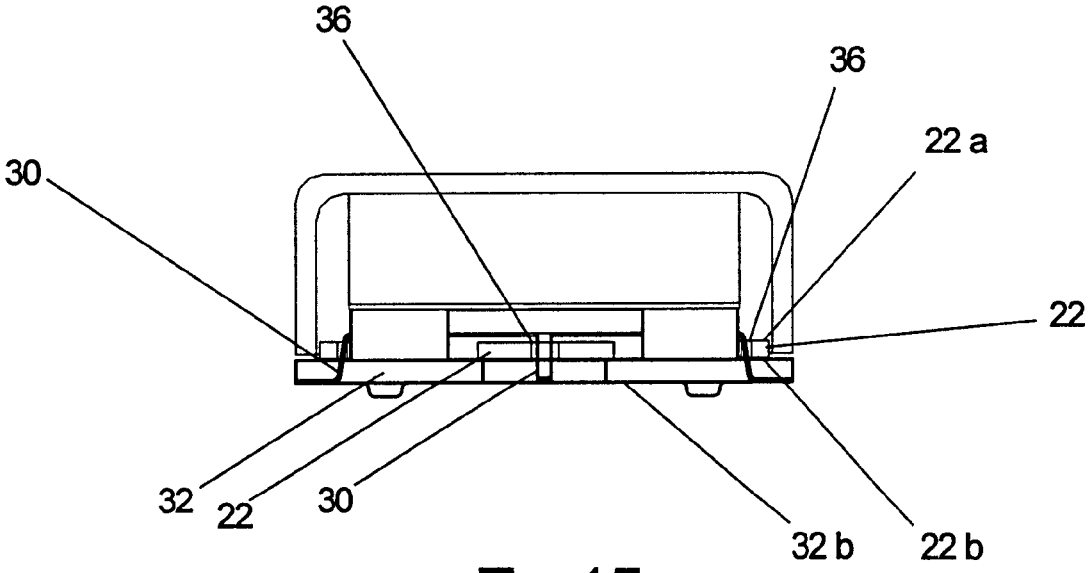
FIG. 15. is a side, cut-away view of a second embodiment of the present invention.

FIG. 15 is a side view of the second embodiment of the present invention as shown in FIG. 14. It illustrates the circuit tab (30) which extends through the aperture (36) to the baseplate bottom surface (32B) for contact with other conductive pathways (not shown). Two embodiments exist for insert (22) which allow communication from the circuit (12) to other electronics. The first embodiment incorporates the microstrip (24) which is embedded within insert (22) and extends from the insert top surface (22A) through insert (22) to the insert bottom surface (22B). The microstrip (24) contacts the circuit tab (30) at the insert top surface (22A) and contacts other conductive pathways (not shown) at the insert bottom surface (22B). The second embodiment of the insert (22), as shown in FIG. 14, has an aperture (36) that extends through insert (22). In this embodiment, the circuit tab (30) is extended directly through the aperture (36) from the insert top surface to the insert bottom surface (22B) where the circuit tab (30) directly contacts other conductive pathways (not shown). The aperture (36) can then be filled with an insulative substance (not shown).

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

We claim:

1. A circulator comprising:

a grounded circuit assembly further comprising:

a first ferrite disk having an inner surface and an outer surface;

a second ferrite disk having an inner surface and an outer surface;

a circuit disposed between said first ferrite inner surface and said second ferrite inner surface, said circuit having a circuit tab;

a grounding foil wrap disposed about said first ferrite outer surface and said second ferrite outer surface, said wrap not contacting said circuit or said circuit tabs;

a baseplate having a top surface and a bottom surface; and said grounded circuit assembly attached to said top surface of said baseplate.

2. The circulator of claim 1, wherein:

said first ferrite disk and said second ferrite disk are like-shaped polygons and are attached by adhesive at the corners of said ferrite disks, said adhesive does not contact said circuit.

3. The circulator of claim 1, further comprising:

said baseplate having an outer edge with a plurality of notches, each of said notches shaped to accept an insert;

said inserts having a top surface and a bottom surface; and a microstrip embedded within said insert with a first end beyond said insert top surface and a second end extending beyond said insert bottom surface, and said first end in contact with said circuit tab.

4. The circulator of claim 1, further comprising:

an insulating cover attached to said baseplate.

5. A circulator comprising:

a grounded circuit assembly further comprising:

a first ferrite disk having an inner surface and an outer surface;

a second ferrite disk having an inner surface and an outer surface;

a circuit disposed between said first ferrite inner surface and said second ferrite inner surface, said circuit having a circuit tab;

a grounding foil wrap disposed about said first ferrite outer surface and said second ferrite outer surface, said wrap not contacting said circuit or said circuit tabs;

a baseplate having a top surface and a bottom surface;

said grounded circuit assembly attached to said top surface of said baseplate, said baseplate having an outer edge with a plurality of notches, each of said notches shaped to accept an insert;

said inserts having a top surface and a bottom surface;

a microstrip embedded within said insert with a first end beyond said insert top surface and a second end extending beyond said insert bottom surface, and said first end in contact with said circuit tab; and an insulating cover attached to said baseplate.

6. A circulator comprising:

a grounded circuit assembly further comprising:

a first ferrite disk having an inner surface and an outer surface;

a second ferrite disk having an inner surface and an outer surface;

a circuit disposed between said first ferrite inner surface and said second ferrite inner surface, said circuit having a circuit tab;

said first ferrite disk and said second ferrite disk being like-shaped polygons and said first ferrite inner surface attached by non-conductive fasteners at the corners of said ferrite disks to said second ferrite inner surface, said non-conductive fasteners do not contact said circuit;

a grounding foil wrap disposed about said first ferrite outer surface and said second ferrite outer surface, said wrap not contacting said circuit or said circuit tabs;

a baseplate having a top surface and a bottom surface;

said grounded circuit assembly attached to said top surface of said baseplate, said baseplate having an outer edge with a plurality of notches, each of said notches shaped to accept an insert;

said inserts having a top surface and a bottom surface;

a microstrip embedded within said insert with a first end beyond said insert top surface and a second end extending beyond said insert bottom surface, and said first end in contact with said circuit tab; and an insulating cover attached to said baseplate.

7. The circulator of claim 6, wherein:

said non-conductive fasteners comprise an adhesive.

* * * * *